US011512488B2

(12) United States Patent
Huang et al.

(10) Patent No.: US 11,512,488 B2
(45) Date of Patent: Nov. 29, 2022

(54) ABOVE-GROUND FRAME POOL HAVING A TRANSLUCENT WALL PORTION

(71) Applicant: Intex Industries Xiamen Co. Ltd., Fujian (CN)

(72) Inventors: Zhi Xiong Huang, Fujian (CN); Ai Ming Tan, Fujian (CN); Jian Li, Fujian (CN)

(73) Assignee: Intex Marketing Ltd., Tortola (VG)

( * ) Notice: Subject to any disclaimer, the term of this patent is extended or adjusted under 35 U.S.C. 154(b) by 0 days.

(21) Appl. No.: 17/101,205

(22) Filed: Nov. 23, 2020

(65) Prior Publication Data

US 2021/0164249 A1 Jun. 3, 2021

(30) Foreign Application Priority Data

Nov. 29, 2019 (CN) ..... 201922108560.X

(51) Int. Cl.
*E04H 4/00* (2006.01)

(52) U.S. Cl.
CPC ..... *E04H 4/0056* (2013.01)

(58) Field of Classification Search
CPC ..... E04H 4/0056; E04H 4/0018; E04H 2004/0068
USPC ..... 4/513
See application file for complete search history.

(56) References Cited

U.S. PATENT DOCUMENTS

D239,702 S 4/1976 Bukaitz
5,416,932 A * 5/1995 Ventrice ..... E04H 4/14 4/496
D408,546 S 4/1999 Carreau
D453,839 S 2/2002 Rho
6,588,028 B1 * 7/2003 Wu ..... E04H 4/0025 4/506
D484,611 S 12/2003 Bonnin
D485,618 S 1/2004 Bonnin
D697,636 S 1/2014 Paxton
D753,318 S 4/2016 Kweller
D793,575 S 8/2017 Lin
D835,806 S 12/2018 Huang
10,161,149 B2 * 12/2018 Liu ..... E04H 4/0056
10,385,579 B2 8/2019 Leung et al.
10,426,891 B2 * 10/2019 Johansen ..... A61M 5/20
(Continued)

FOREIGN PATENT DOCUMENTS

CN 304666029 2/2019
WO 2007/025074 A2 3/2007
WO 2018/201372 A1 11/2018

OTHER PUBLICATIONS

Inflatable Pools, Intex Recreation Corp, catalog, published in 2012; 2 pages.

(Continued)

*Primary Examiner* — Huyen D Le
(74) *Attorney, Agent, or Firm* — Faegre Drinker Biddie & Reath LLP

(57) ABSTRACT

A liner for an above-ground frame pool is provided. The liner includes a bottom wall and a sidewall coupled to the bottom wall and defining a water cavity together with the bottom wall. The sidewall has a substantially cylindrical shape, and the sidewall includes a translucent portion facilitating viewing between the water cavity and an exterior of the above-ground frame pool. The translucent portion has a substantially semi-cylindrical shape.

18 Claims, 10 Drawing Sheets

(56) References Cited

U.S. PATENT DOCUMENTS

| | | | | |
|---|---|---|---|---|
| D874,021 | S | 1/2020 | Huang | |
| 2004/0040082 | A1* | 3/2004 | Fireman | E04H 4/0025 4/506 |
| 2009/0205121 | A1* | 8/2009 | Cheng | E04H 4/0056 4/506 |
| 2010/0294759 | A1* | 11/2010 | Yu | E04H 15/006 220/9.3 |
| 2015/0167336 | A1 | 6/2015 | Leung | |
| 2017/0356206 | A1 | 12/2017 | Huang | |
| 2019/0360228 | A1 | 11/2019 | Leung et al. | |
| 2020/0332544 | A1 | 10/2020 | Huang | |

OTHER PUBLICATIONS

Bling Kiddie Pool, Jun. 17, 2020, Amazon, https://www.amazon.com/WateBom-Glitter-Inflatable-Swimming-Durable/dp/B08BC7MS2J (Year: 2020).

Bling Kiddie Pool, Jun. 17, 2020, 60 inches Glitter Inflatable Kids Swimming Pool, Ball Pit, 5ft Durable Baby Pool for Indoor or Outdoor; Amazon, https://www.amazon.com/WateBom-Glitter-Inflatable-Swimming-Durable/dp/B08BC7MS2J; 1 page.

PinkCosmoCrafts, Coleman Pool Review, Youtube, https://www.youtube.com/watch?v=U5nQPWLy90Y; Jun. 8, 2018; 1 page.

* cited by examiner

ABOVE-GROUND FRAME POOL HAVING A TRANSLUCENT WALL PORTION

CROSS REFERENCE TO RELATED APPLICATION

This application claims priority to Chinese Application No. CN201922108560.X, filed Nov. 29, 2019, the disclosure of which is hereby expressly incorporated by reference herein in its entirety.

FIELD OF THE DISCLOSURE

The present disclosure relates to an above-ground frame pool. More particularly, the present disclosure relates to an above-ground frame pool that includes a frame assembly and a liner supported by the frame assembly, and the liner includes a translucent portion.

BACKGROUND OF THE DISCLOSURE

Above-ground frame pools are popular recreational products. Such above-ground frame pools typically include a frame assembly and a liner supported by the frame assembly, and the liner defines a water cavity of the pool. While above-ground frame pools are relatively convenient, easy to assemble, and inexpensive compared to in-ground pools, the frame assembly and the liner may significantly obscure the view into and out from the water cavity of the pool.

SUMMARY OF THE DISCLOSURE

The present disclosure provides an above-ground frame pool including a frame assembly and a liner supported by the frame assembly. The liner includes a sidewall that has one or more translucent portions. The translucent portions facilitate viewing the majority of the water cavity of the pool from the exterior of the pool and viewing the exterior surroundings from the water cavity of the pool.

According to an exemplary embodiment of the present disclosure, a liner for an above-ground frame pool includes a bottom wall and a sidewall coupled to the bottom wall and defining a water cavity together with the bottom wall. The sidewall has a substantially cylindrical shape, and the sidewall includes a translucent portion facilitating viewing between the water cavity and an exterior of the above-ground frame pool. The translucent portion has a substantially semi-cylindrical shape.

In certain embodiments, the sidewall further includes a lower sidewall portion coupled to the bottom wall and the translucent portion opposite the bottom wall, and an upper sidewall portion coupled to the translucent portion opposite the lower sidewall portion.

In certain embodiments, the sidewall further includes an intermediate sidewall portion coupling the lower sidewall portion and the upper sidewall portion, and the intermediate sidewall portion includes the translucent portion and an opaque portion coupled to the translucent portion. The opaque portion has a substantially semi-cylindrical shape.

In certain embodiments, the translucent portion is a first translucent portion, the intermediate sidewall portion further includes a second translucent portion, the second translucent portion has a substantially semi-cylindrical shape, and the opaque portion is disposed circumferentially between the first translucent portion and the second translucent portion.

According to another exemplary embodiment of the present disclosure, a liner for an above-ground frame pool includes a bottom wall and a sidewall coupled to the bottom wall and defining a water cavity together with the bottom wall. The sidewall includes a lower sidewall portion, an intermediate sidewall portion, and an upper sidewall portion. The lower sidewall portion is coupled to the bottom wall. The intermediate sidewall portion is coupled to the lower sidewall opposite the bottom wall. The intermediate sidewall portion includes a translucent portion facilitating viewing between the water cavity and an exterior of the above-ground frame pool. The upper sidewall portion is coupled to the intermediate sidewall portion opposite the lower sidewall portion.

In certain embodiments, the sidewall includes a substantially cylindrical shape.

In certain embodiments, the translucent portion includes a substantially semi-cylindrical shape.

In certain embodiments, the translucent portion defines an arc having an angle of substantially 157.5 degrees.

In certain embodiments, the intermediate sidewall portion further includes an opaque portion.

In certain embodiments, the translucent portion is a first translucent portion and the intermediate sidewall portion further includes a second translucent portion, and the opaque portion is disposed between the first translucent portion and the second translucent portion.

In certain embodiments, the opaque portion is a first opaque portion and the intermediate sidewall portion further includes a second opaque portion, and the second opaque portion is disposed between the first translucent portion and the second translucent portion.

In certain embodiments, the first opaque portion and the second opaque portion are disposed circumferentially between the first translucent portion and the second translucent portion.

According to yet another exemplary embodiment of the present disclosure, an above-ground frame pool includes a frame assembly, and the frame assembly includes a plurality of horizontal members and a plurality of vertical members coupled to the plurality of horizontal members. The pool further includes a liner supported by the frame assembly. The liner includes a bottom wall and a sidewall coupled to the bottom wall and defining a water cavity together with the bottom wall. The sidewall includes a translucent portion facilitating viewing between the water cavity and an exterior of the above-ground frame pool. The translucent portion is disposed between the water cavity and the plurality of vertical members.

In certain embodiments, the sidewall includes a substantially cylindrical shape.

In certain embodiments, the translucent portion includes a substantially semi-cylindrical shape.

In certain embodiments, the sidewall includes an intermediate sidewall portion, the intermediate sidewall portion including the translucent portion and an opaque portion.

In certain embodiments, the translucent portion is a first translucent portion and the intermediate sidewall portion further includes a second translucent portion, and the opaque portion is disposed between the first translucent portion and the second translucent portion.

In certain embodiments, the opaque portion is a first opaque portion and the intermediate sidewall portion further includes a second opaque portion, and the second opaque portion is disposed between the first translucent portion and the second translucent portion.

In certain embodiments, the sidewall further includes an upper sidewall portion coupled to the plurality of horizontal members.

In certain embodiments, the pool further includes a tension band disposed around the sidewall.

Additional features and advantages of the present invention will become apparent to those skilled in the art upon consideration of the following detailed description of the drawings exemplifying the best mode of carrying out the invention as presently perceived.

BRIEF DESCRIPTION OF THE DRAWINGS

The foregoing aspects and many of the intended advantages of this invention will become more readily appreciated as the same becomes better understood by reference to the following detailed description when taken in conjunction with the accompanying drawings.

Figure 1:
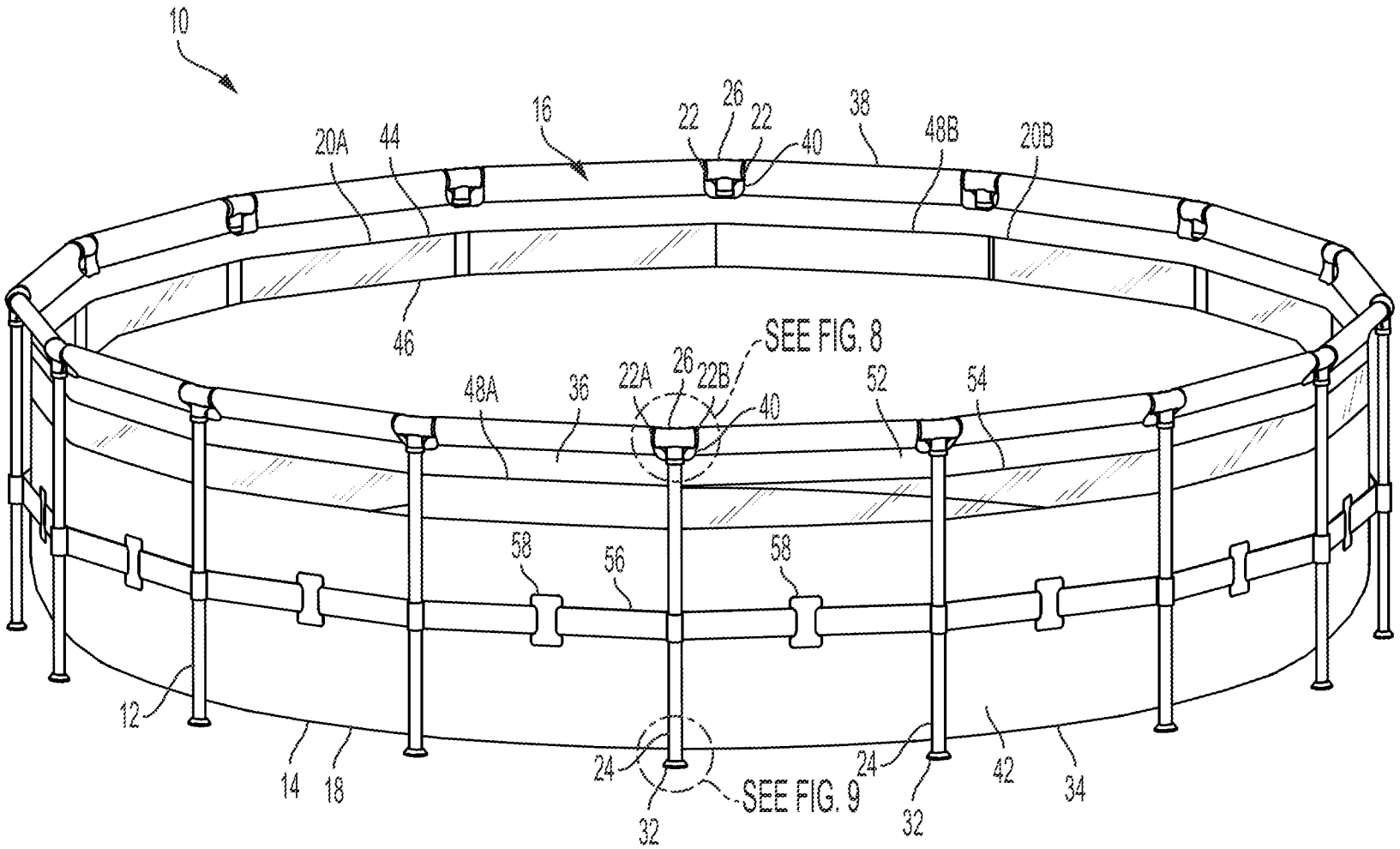
FIG. 1 is a perspective view of an above-ground frame pool according to an embodiment of the present disclosure.
Figure 2:
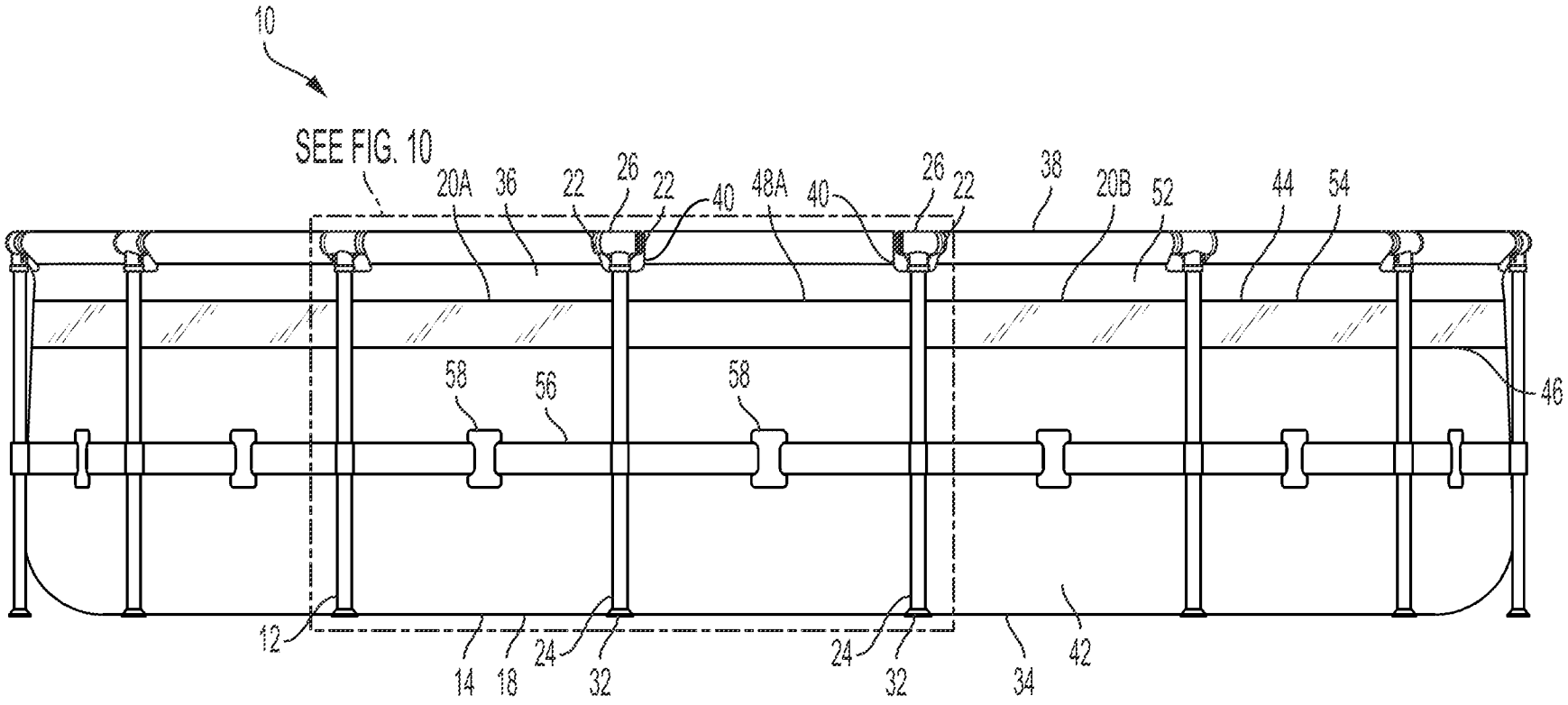
FIG. 2 is a front view of the pool of FIG. 1.
Figure 3:
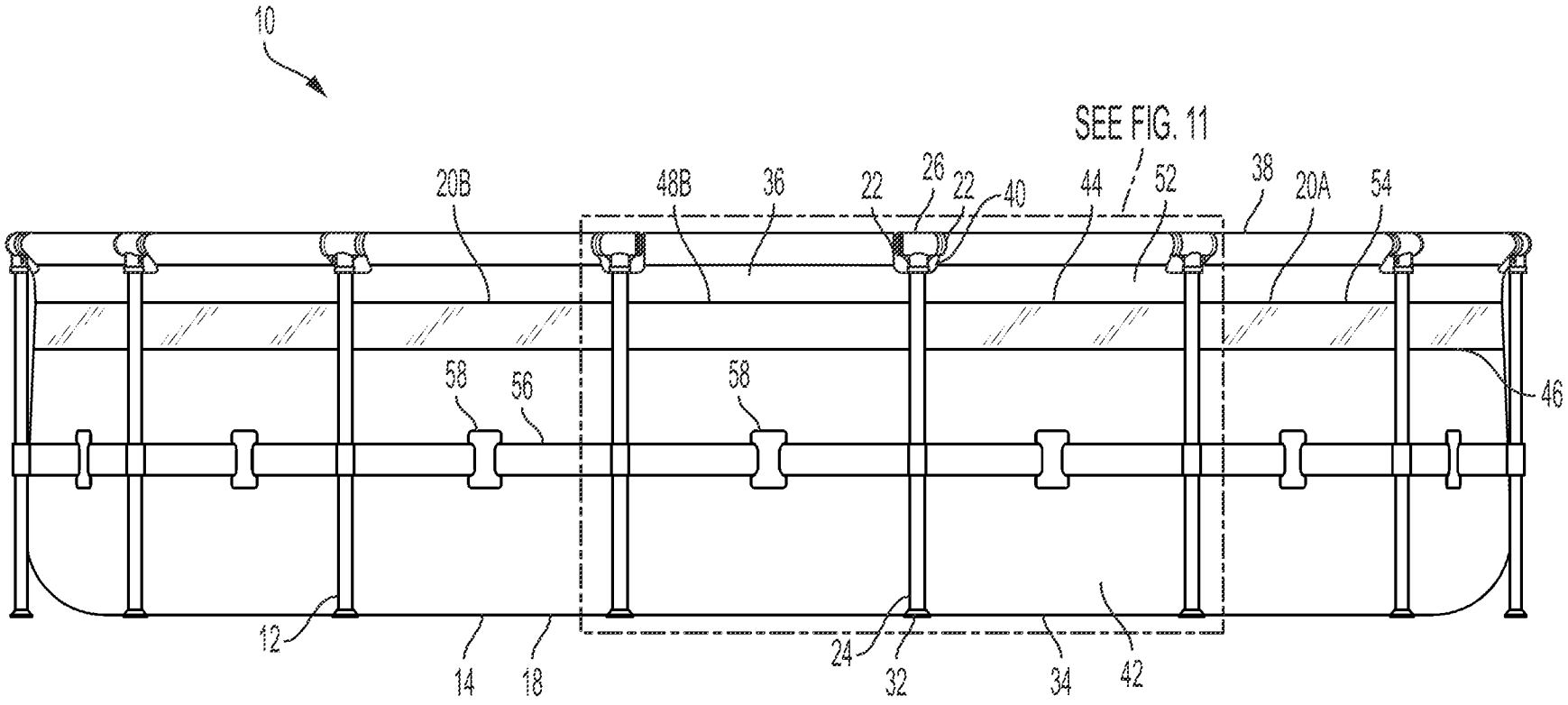
FIG. 3 is a rear view of the pool of FIG. 1.
Figure 4:
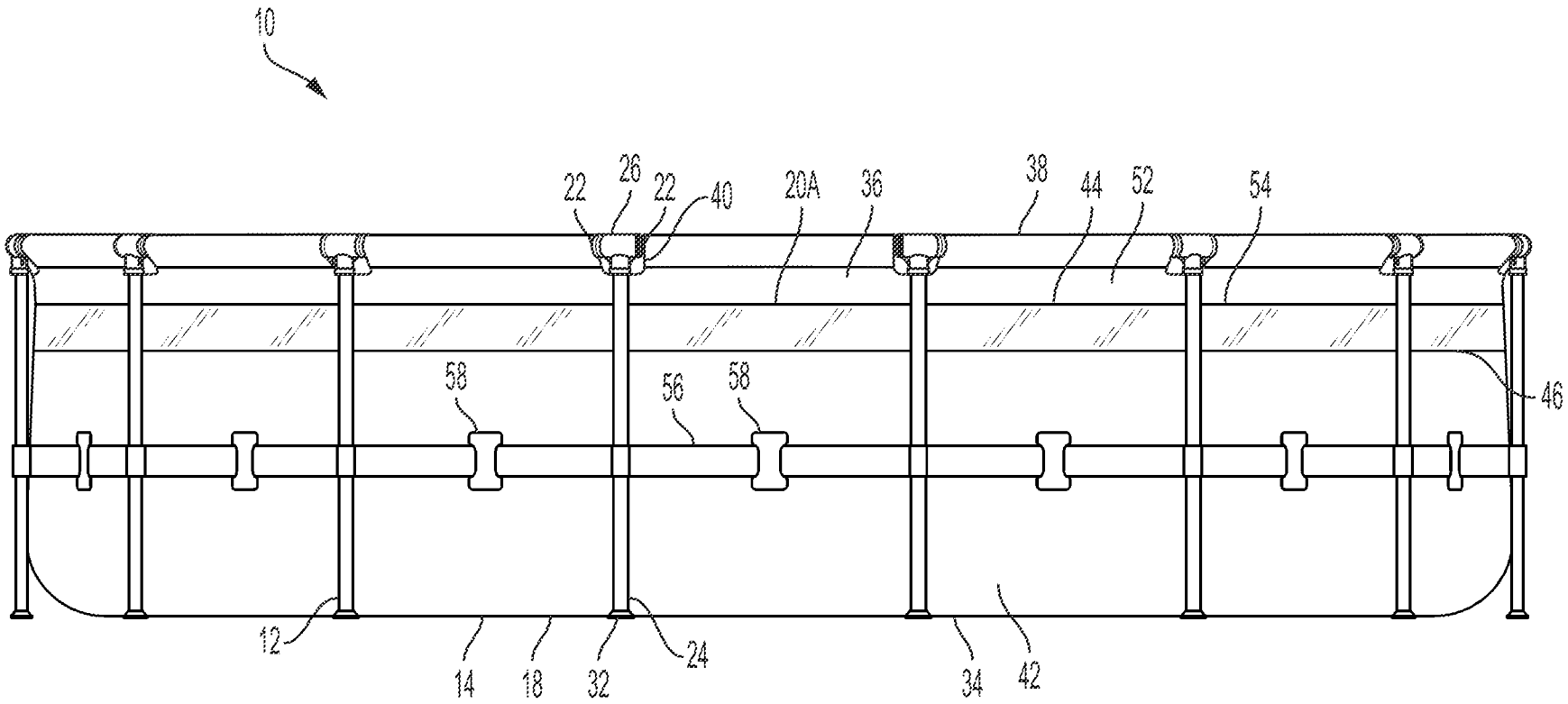
FIG. 4 is a left side view of the pool of FIG. 1.
Figure 5:
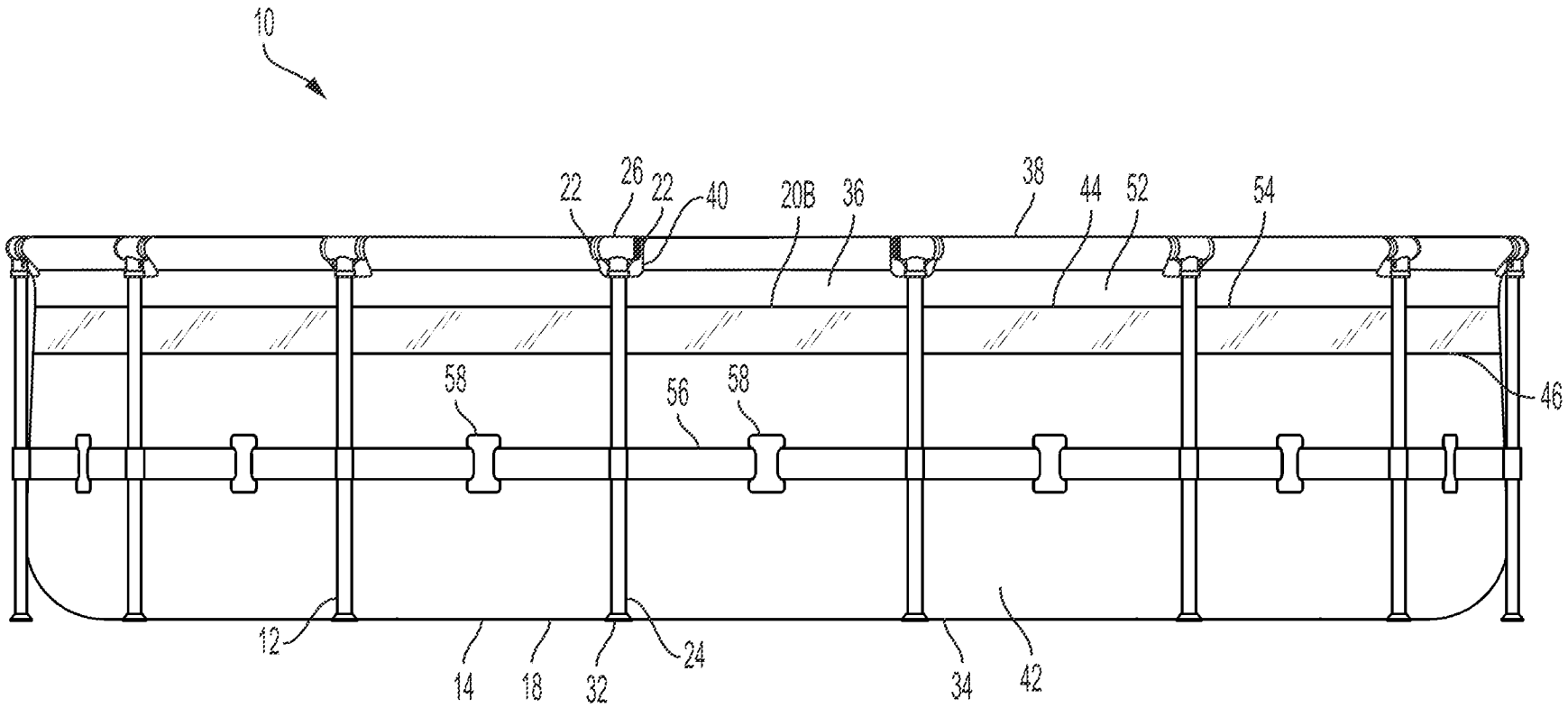
FIG. 5 is a right side view of the pool of FIG. 1.
Figure 6:
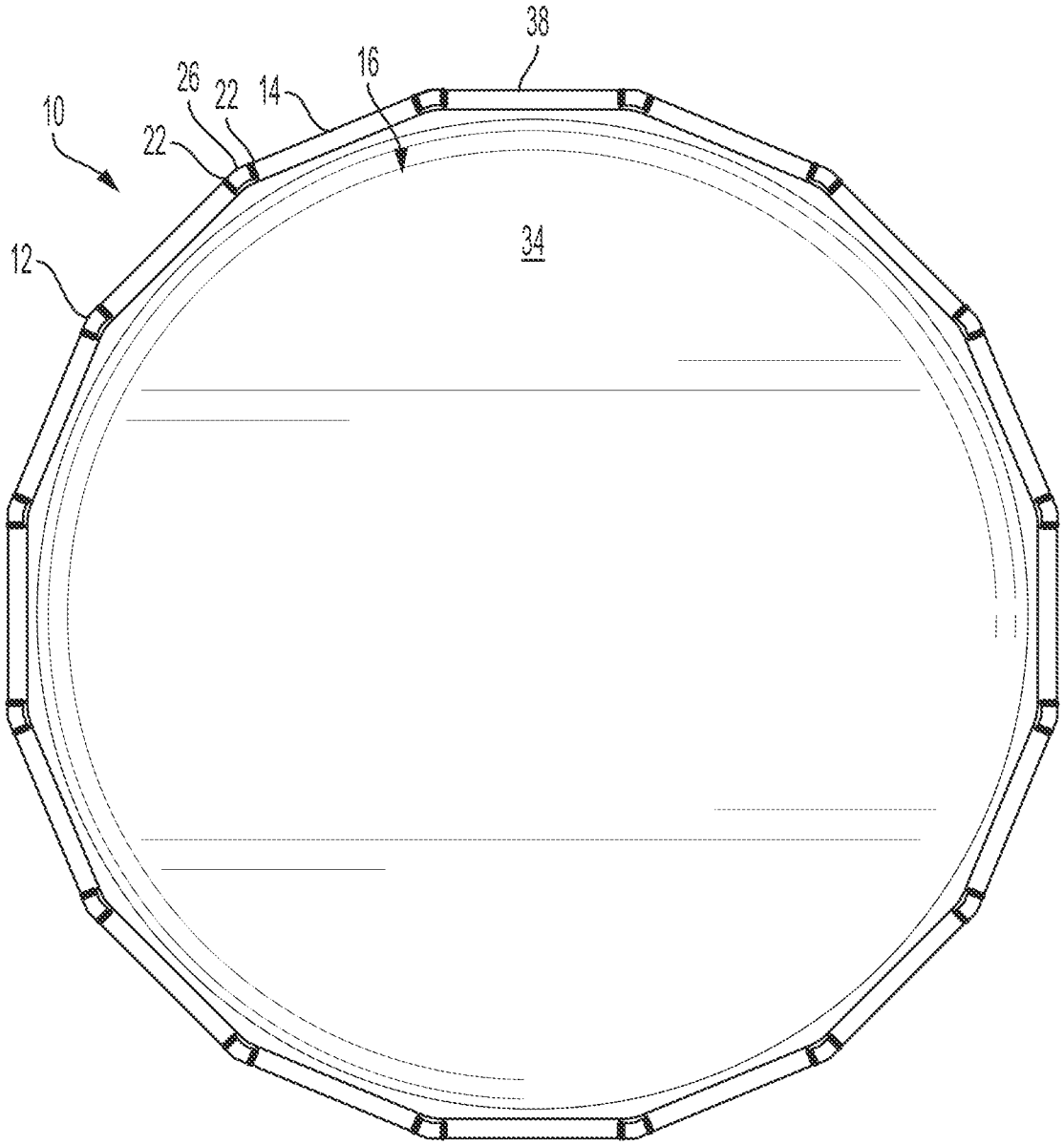
FIG. 6 is a top view of the pool of FIG. 1.
Figure 7:
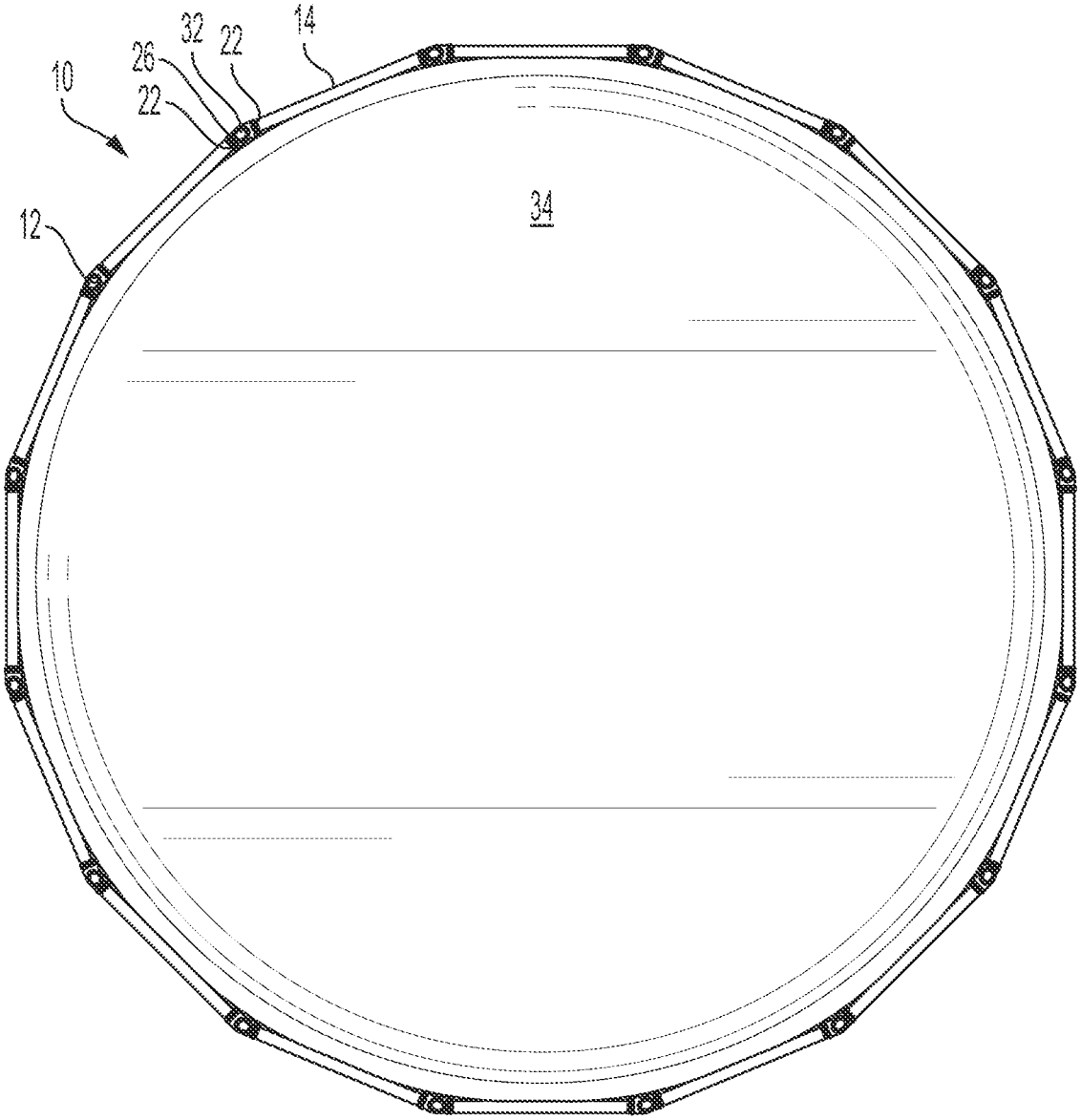
FIG. 7 is a bottom view of the pool of FIG. 1.

Corresponding reference characters indicate corresponding parts throughout the several views. Although the drawings represent embodiments of various features and components according to the present disclosure, the drawings are not necessarily to scale and certain features may be exaggerated in order to better illustrate and explain the present disclosure. The exemplification set out herein illustrates an embodiment of the invention, and such an exemplification is not to be construed as limiting the scope of the invention in any manner.

DETAILED DESCRIPTION OF THE DRAWINGS

For the purposes of promoting an understanding of the principals of the invention, reference will now be made to the embodiments illustrated in the drawings, which are described below. The embodiments disclosed below are not intended to be exhaustive or limit the invention to the precise form disclosed in the following detailed description. Rather, the embodiments are chosen and described so that others skilled in the art may utilize their teachings. It will be understood that no limitation of the scope of the invention is thereby intended. The invention includes any alterations and further modifications in the illustrative devices and described methods and further applications of the principles of the invention which would normally occur to one skilled in the art to which the invention relates.

Referring to FIGS. 1-7, an above-ground frame pool 10 according to an embodiment of the present disclosure is illustrated. The pool 10 includes a frame assembly 12 that supports and generally surrounds a liner 14. The liner 14 defines a water cavity 16 of the pool 10, and a sidewall 18 of the liner 14 includes one or more (illustratively, two) translucent portions 20A, 20B that facilitate viewing between the water cavity 16 and the exterior of the pool 10. The pool 10 illustratively has a substantially cylindrical shape (as used herein, "substantially cylindrical" means that the sidewall 18 may be disposed at an angle of at most 10 degrees relative to the vertical direction). Alternatively the pool 10 may have other shapes, such as a three-dimensional elliptical shape, a three-dimensional rectangular shape, or the like.

The frame assembly 12 may be the same as or similar to any of the frame assemblies described in International Publication No. WO 2020/058854, the disclosure of which is hereby expressly incorporated by reference herein in its entirety. More specifically and referring to FIGS. 1, 8, and 9, the illustrative frame assembly 12 includes a plurality of horizontal frame members or pipes 22 positioned along the perimeter of the pool 10 and a plurality of vertical frame members or pipes 24 extending vertically downward to support the horizontal members 22 above a supporting surface (for example, the ground). Because the pool 10 is illustrated as having a substantially cylindrical shape, the horizontal members 22 are arranged in a ring-shape and positioned along the circumference of the pool 10. Alternatively, the horizontal members 22 may be arranged in other shapes to form pools 10 of different shapes. The frame members 22, 24 may be constructed of various suitable materials, including rigid plastics, metals, other suitable corrosion-resistant materials, combinations thereof, and the like.

Figure 8:
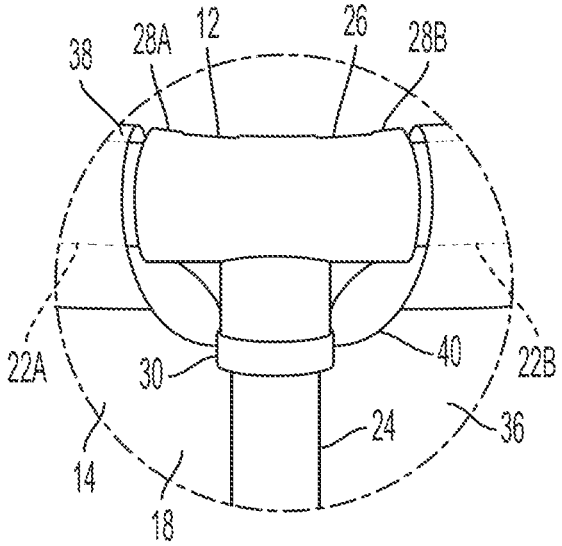
FIG. 8 is a detail view within line 8-8 of FIG. 1 illustrating an exemplary T-joint, horizontal frame members, and vertical frame member of a frame assembly of the pool.

Referring specifically to FIG. 8, the frame assembly 12 also includes a plurality of T-shaped joints 26 (hereinafter, "T-joints") that connect adjacent horizontal members 22 and vertical members 24. Each T-joint 26 includes a first horizontal portion 28A with a first hollow end (not shown) that receives a first horizontal member 22A, a second horizontal portion 28B with a second hollow end (not shown) that receives an adjacent second horizontal member 22B, and a vertical portion 30 with a hollow end (not shown) that receives the upper end of an adjacent vertical member 24. Each T-joint 26 may include one or more locking mechanisms configured to interact with the adjacent frame members 22, 24, such as a spring-biased pin (not shown) that is received in an opening (not shown) formed on the vertical member 24. The first and second horizontal portions 28A, 28B of each T-joint 26 are bent radially inward relative to the vertical portion 30 of the T-joint 26 to form an included angle (not shown) measuring less than 180 degrees, such as an obtuse angle (that is, between 90 degrees and 180 degrees) or a right angle (that is, 90 degrees). The T-joints 26 may be constructed of various suitable materials, including rigid plastics, metals, other suitable corrosion-resistant materials, combinations thereof, and the like.

Figure 9:
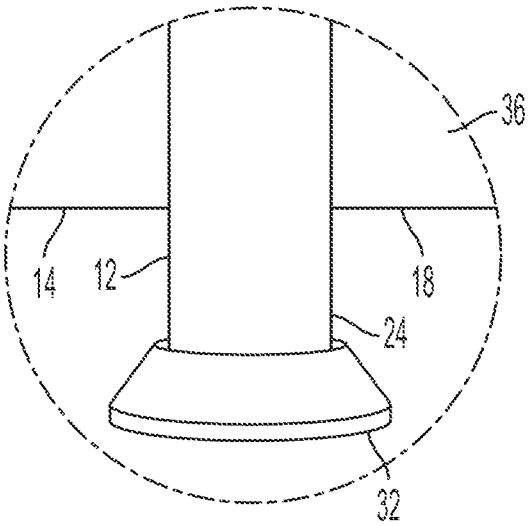
FIG. 9 is a detail view within line 9-9 of FIG. 1 illustrating an exemplary vertical frame member and lower foot of the frame assembly of the pool.

Referring specifically to FIG. 9, the frame assembly 12 further includes a lower foot 32 carried at the lower end of each vertical frame member 24. Each lower foot 32 is configured to engage the supporting surface and may be constructed of one or more anti-slip materials.

Figure 10:
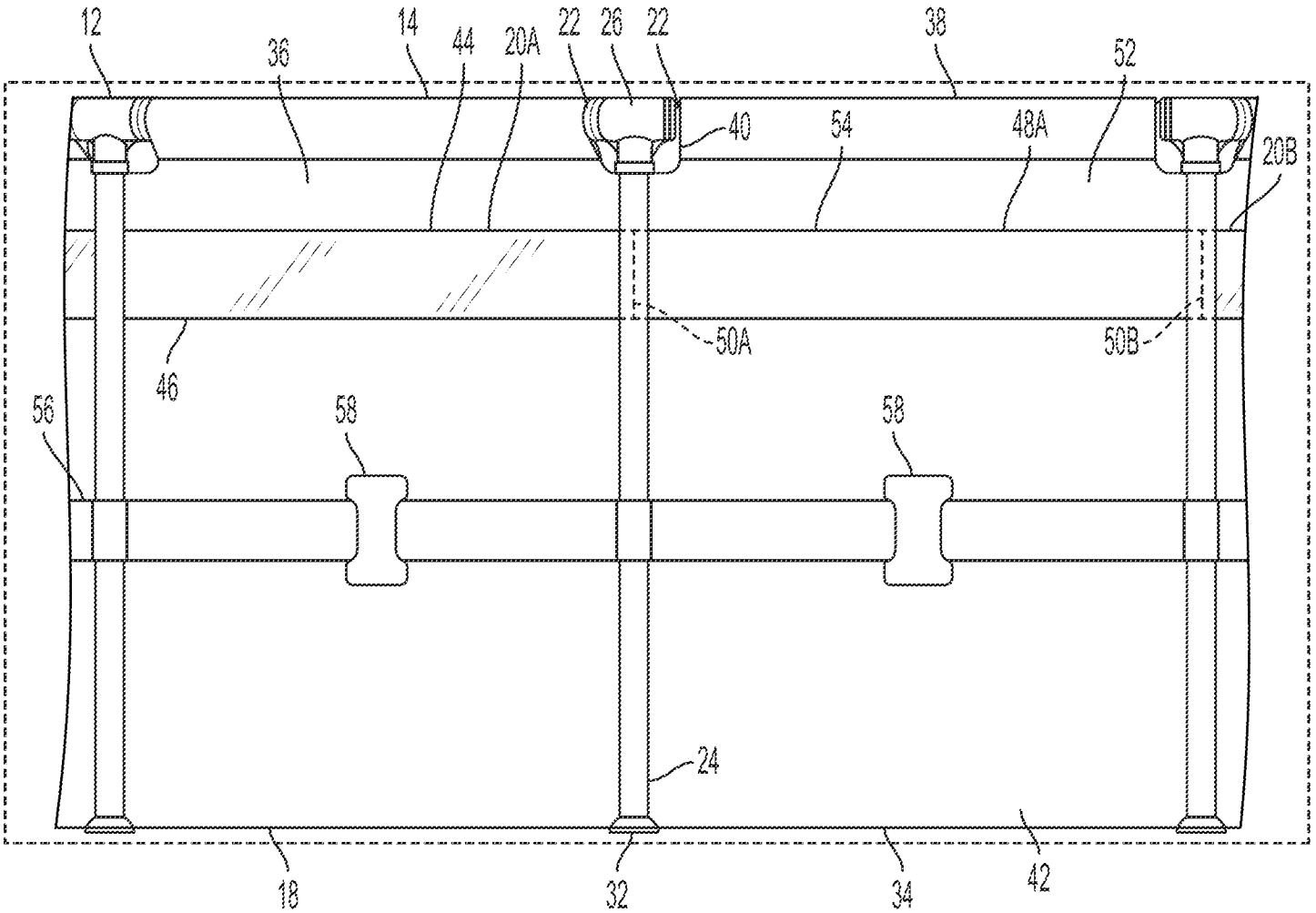
FIG. 10 is a detail view within line 10-10 of FIG. 1 illustrating an exemplary portion of a liner and the frame assembly of the pool.
Figure 11:
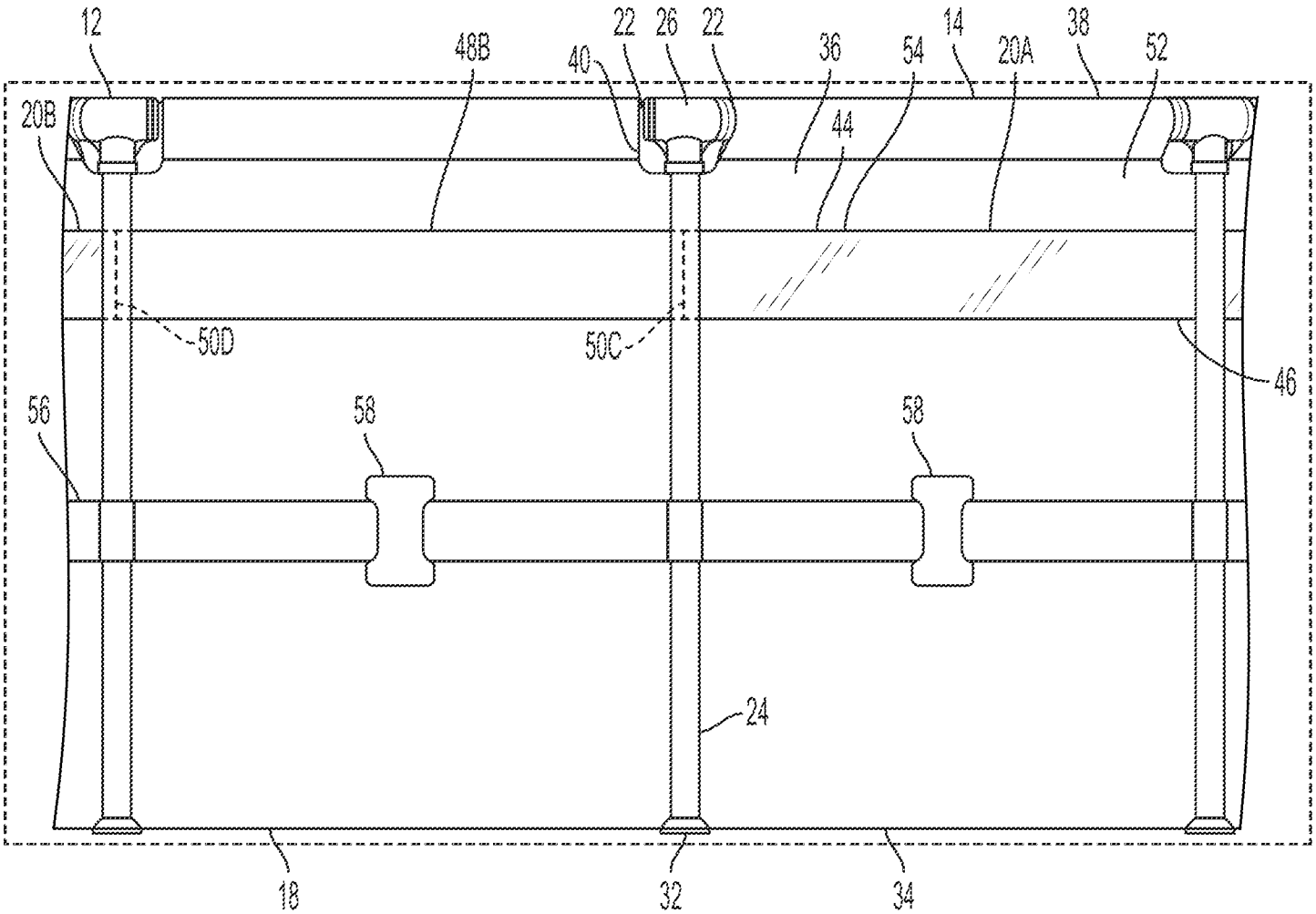
FIG. 11 is a detail view within line 11-11 of FIG. 1 illustrating another exemplary portion of the liner and the frame assembly of the pool.

Referring now to FIGS. 1, 10, and 11, the liner 14 generally includes a bottom wall or sheet 34 and a sidewall or sheet 36 that together define the water cavity 16 of the pool 10. The sidewall 36 may include a water inlet (not shown) and a water outlet (not shown) to facilitate fluid communication between the water cavity 16 and an external water filtration and/or heating system (not shown). The liner 14 also includes an upper sleeve 38 for receiving the horizontal members 22 of the frame assembly 12. The upper sleeve 38 may include a plurality of openings 40 corresponding to the T-joints 26 to facilitate assembly and disassembly of the frame assembly 12, more specifically assembly and disassembly of the frame members 22, 24 from the T-joints 26.

With continued reference to FIGS. 1, 10, and 11, the sidewall 18 of the liner 14 includes a lower sidewall portion 42 that couples to the bottom wall 34. The lower sidewall portion 42 couples to an intermediate sidewall portion 44 at a first circumferential seam 46 opposite the bottom wall 34. The intermediate sidewall portion 44 includes the first and second translucent portions 20A, 20B of the liner 14. The intermediate sidewall portion 44 also includes one or more (illustratively, two) opaque portions 48A, 48B disposed circumferentially between the translucent portions 20A, 20B. The first opaque portion 48A couples to the first translucent portion 20A at a first longitudinal seam 50A (FIG. 10; that is, extending in a direction substantially parallel to a longitudinal axis (not shown) of the pool 10 and/or perpendicular to the first circumferential seam 46) and the second translucent portion 20B at a second longitudinal seam 50B. The second opaque portion 48B couples to the first translucent portion 20A at a third longitudinal seam 50C (FIG. 11) and the second translucent portion 20B at a fourth longitudinal seam 50D. The sidewall 18 of the liner 14 further includes an upper sidewall portion 52 coupled to the intermediate sidewall portion 44 at a second circumferential seam 54 opposite the lower sidewall portion 42. In some embodiments and as illustrated, the intermediate sidewall portion 44 is substantially aligned with a water line (that is, a recommended or maximum water fill level) of the pool 10, such that the lower sidewall portion 42 is positioned beneath the water line and the upper sidewall portion 52 is positioned above the water line. This placement facilitates viewing by and of swimmers in the pool 10, particularly swimmers who are positioned at least partially at the water line.

The translucent portions 20A, 20B of the liner 14 may be constructed of various translucent materials, including, for example, flexible plastics and adhesive tapes having one or more layers. In addition, the transparent materials may be, for example, clear transparent materials, color transparent materials, "frosted" translucent materials, or the like. The lower sidewall portion 42, the opaque portions 48A, 48B, and the upper sidewall portion 52 may be constructed of various suitable waterproof materials including, for example, flexible polyvinyl chloride (PVC) material or a flexible adhesive tape. Such materials may include one or more nylon or polyester mesh reinforcement layers. The translucent portions 20A, 20B of the liner 14 may be coupled to the lower sidewall portion 42, the opaque portions 48A, 48B, and the upper sidewall portion 52 via high-frequency wave welding or high-temperature hot welding.

As noted above, the pool 10, more specifically the sidewall 18, is illustrated as having a substantially cylindrical shape. Similarly, translucent portions 20A, 20B and the opaque portions 48A, 48B each have substantially semi-cylindrical shapes (as used herein, "substantially semi-cylindrical" means that a portion of the sidewall 18 is partially cylindrical and may be disposed at an angle of at most 10 degrees relative to the vertical direction). In some embodiments and as illustrated, the translucent portions 20A, 20B may together extend over the majority of the circumference of the sidewall 18 to facilitate panoramic viewing into and out from the water cavity 16. More specifically, the translucent portions 20A, 20B may together extend over 75 percent of the circumference of the sidewall 18, over 80 percent of the circumference of the sidewall 18, over 85 percent of the circumference of the sidewall 18, over 90 percent of the circumference of the sidewall 18, or over 95 percent of the circumference of the sidewall 18. In some embodiments and as illustrated, the translucent portions 20A, 20B may each define an arc having an angle of about 135 degrees to about 170 degrees, such as substantially 157.5 degrees (that is, 157.5 degrees±2.5 degrees). In some embodiments and as illustrated, the opaque portions 48A, 48B may each define an arc having an angle of about 10 degrees to about 45 degrees, such as substantially 22.5 degrees (that is, 22.5 degrees±2.5 degrees). In other embodiments, the translucent portions 20A, 20B and/or the opaque portions 48A, 48B may define arcs having different angles. In some embodiments and as illustrated, each longitudinal seam 50A, 50B, 50C, and 50D may be circumferentially aligned with one of vertical frame members 24. The translucent portion 20A may span continuously between the longitudinal seams 50A, 50C, passing behind one or more intermediate vertical frame members 24 before reaching the vertical frame members 24 aligned with the longitudinal seams 50A, 50C. Similarly, the translucent portion 20B may span continuously between the longitudinal seams 50B, 50D, passing behind one or more intermediate vertical frame members 24 before reaching the vertical frame members 24 aligned with the longitudinal seams 50B, 50D. In this way, vertical frame members 24 may obscure only small viewing areas through translucent portions 20A, 20B.

In other embodiments, the intermediate sidewall portion 44 of the liner 14 may include different structures. For example, the intermediate sidewall portion 44 may include a different number of translucent portions and opaque portions. As a specific example, the intermediate sidewall portion 44 may include three translucent portions and three opaque portions, and each opaque portion is disposed between adjacent translucent portions. As another specific example, the intermediate sidewall portion 44 may include four translucent portions and four opaque portions, and each opaque portion is disposed between adjacent translucent portions. As yet another example, the intermediate sidewall portion 44 may include a single translucent portion and lack opaque portions.

The pool 10 further includes a tension band 56 for stabilizing the frame assembly 12 and the liner 14. Illustratively, the tension band 56 is disposed around the sidewall 18 of the liner 14 and the vertical members 24 of the frame assembly 12. Alternatively, the tension band 56 may be disposed between the sidewall 18 of the liner 14 and the vertical members 24 of the frame assembly 12. A plurality of connectors 58 may secure the tension band 56 to the sidewall 18 of the liner 14. In some embodiments and as illustrated, the intermediate sidewall portion 44 is substantially parallel to the tension band 56.

While the present invention has been described in the context of several embodiments, the present invention may be further modified within the spirit and scope of this disclosure. This application is therefore intended to cover any variations, uses, or adaptations of the invention using its general principles. Further, this application is intended to cover such departures from the present disclosure as come within known or customary practices in the art to which this invention pertains.

What is claimed is:

1. A liner for an above-ground frame pool, the liner comprising:

a bottom wall; and a sidewall coupled to the bottom wall and defining a water cavity together with the bottom wall, the sidewall having a substantially cylindrical shape, and the sidewall comprising a translucent portion facilitating viewing between the water cavity and an exterior of the above-ground frame pool, the translucent portion extending over at least 75 percent of a circumference of the sidewall and having a substantially semi-cylindrical shape.

2. The liner of claim 1, wherein the sidewall further comprises:

a lower sidewall portion coupled to the bottom wall and the translucent portion opposite the bottom wall; and an upper sidewall portion coupled to the translucent portion opposite the lower sidewall portion.

3. The liner of claim 2, wherein the sidewall further comprises an intermediate sidewall portion coupling the lower sidewall portion and the upper sidewall portion, the intermediate sidewall portion comprising:

the translucent portion; and an opaque portion coupled to the translucent portion, the opaque portion having a substantially semi-cylindrical shape.

4. The liner of claim 3, wherein the translucent portion is a first translucent portion, the intermediate sidewall portion further comprises a second translucent portion, the second translucent portion having a substantially semi-cylindrical shape, and the opaque portion disposed circumferentially between the first translucent portion and the second translucent portion.

5. A liner configured to be supported by a frame assembly of an above-ground frame pool, the liner comprising:

a bottom wall;

a sidewall comprising a substantially cylindrical shape and coupled to the bottom wall and defining a water cavity together with the bottom wall, the sidewall comprising:

a lower sidewall portion coupled to the bottom wall;

an intermediate sidewall portion coupled to the lower sidewall opposite the bottom wall, the intermediate sidewall portion comprising a translucent portion facilitating viewing between the water cavity and an exterior of the above-ground frame pool, the translucent portion comprising a substantially semi-cylindrical shape defining an arc having an angle of about 135 degrees to about 170 degrees;

an upper sidewall portion coupled to the intermediate sidewall portion opposite the lower sidewall portion; and a sleeve coupled to the sidewall and configured to couple the liner to the frame assembly.

6. The liner of claim 5, wherein the intermediate sidewall portion further comprises an opaque portion.

7. The liner of claim 6, wherein the translucent portion is a first translucent portion and the intermediate sidewall portion further comprises a second translucent portion, the opaque portion being disposed between the first translucent portion and the second translucent portion.

8. The liner of claim 7, wherein the opaque portion is a first opaque portion and the intermediate sidewall portion further comprises a second opaque portion, the second opaque portion being disposed between the first translucent portion and the second translucent portion.

9. The liner of claim 8, wherein the first opaque portion and the second opaque portion are disposed circumferentially between the first translucent portion and the second translucent portion.

10. An above-ground frame pool comprising:

a frame assembly comprising:

a plurality of horizontal members;

a plurality of vertical members coupled to the plurality of horizontal members;

a liner supported by the frame assembly, the liner comprising:

a bottom wall; and a sidewall coupled to the bottom wall and defining a water cavity together with the bottom wall, the sidewall comprising an intermediate sidewall portion, the intermediate sidewall portion comprising a translucent portion facilitating viewing between the water cavity and an exterior of the above-ground frame pool, the translucent portion disposed between the water cavity and the plurality of vertical members, and an opaque portion, wherein the translucent portion couples with the opaque portion at a location overlapping at least one of the plurality of vertical members.

11. The above-ground frame pool of claim 10, wherein the sidewall comprises a substantially cylindrical shape.

12. The above-ground frame pool of claim 11, wherein the translucent portion comprises a substantially semi-cylindrical shape.

13. The above-ground frame pool of claim 10, wherein the translucent portion is a first translucent portion and the intermediate sidewall portion further comprises a second translucent portion, the opaque portion being disposed between the first translucent portion and the second translucent portion.

14. The above-ground frame pool of claim 13, wherein the first translucent portion defines a first arc having an angle of about 135 degrees to about 170 degrees, and the second translucent portion defines a second arc having an angle of about 135 degrees to about 170 degrees.

15. The above-ground frame pool of claim 13, wherein the opaque portion is a first opaque portion and the intermediate sidewall portion further comprises a second opaque portion, the second opaque portion being disposed between the first translucent portion and the second translucent portion.

16. The above-ground frame pool of claim 10, wherein the sidewall further comprises an upper sidewall portion coupled to the plurality of horizontal members.

17. The above-ground frame pool of claim 10, further comprising a tension band disposed around the sidewall and oriented parallel to the translucent portion.

18. The above-ground frame pool of claim 10, wherein the translucent portion is substantially aligned with a water line of the water cavity.

* * * * *